US008522499B2

(12) United States Patent
Manson

(10) Patent No.: US 8,522,499 B2
(45) Date of Patent: Sep. 3, 2013

(54) DECK DRAINAGE SYSTEM

(76) Inventor: Rodney Manson, Solon, IA (US)

( * ) Notice: Subject to any disclaimer, the term of this patent is extended or adjusted under 35 U.S.C. 154(b) by 453 days.

(21) Appl. No.: 12/857,693

(22) Filed: Aug. 17, 2010

(65) Prior Publication Data

US 2012/0042580 A1 Feb. 23, 2012

(51) Int. Cl.
*E04D 13/064* (2006.01)
*E04F 17/00* (2006.01)

(52) U.S. Cl.
USPC ..... 52/302.4; 52/16; 405/119

(58) Field of Classification Search
USPC ..... 52/302.1, 302.3, 302.4, 302.6, 11, 52/16, 468, 472, 506.05, 506.06, 5, 22; 405/119
See application file for complete search history.

(56) References Cited

U.S. PATENT DOCUMENTS

| | | | | |
|---|---|---|---|---|
| 2,180,317 | A * | 11/1939 | Davis | 52/319 |
| 4,065,883 | A | 1/1978 | Thibodeau | |
| 4,663,894 | A | 5/1987 | LaRoche et al. | |
| 4,860,502 | A | 8/1989 | Mickelsen et al. | |
| 4,918,898 | A * | 4/1990 | McLeod, Jr. | 52/588.1 |
| 5,195,281 | A * | 3/1993 | Kosko | 52/11 |
| 5,287,671 | A * | 2/1994 | Ueki | 52/588.1 |
| 5,511,351 | A | 4/1996 | Moore | |
| 5,765,328 | A * | 6/1998 | Moore | 52/302.1 |
| 6,226,941 | B1 * | 5/2001 | Stevens | 52/302.3 |
| 6,338,228 | B1 * | 1/2002 | Chevalier | 52/220.6 |
| 6,343,450 | B1 * | 2/2002 | Vance, Jr. | 52/302.1 |
| 6,415,571 | B2 | 7/2002 | Risser | |
| 6,688,059 | B1 * | 2/2004 | Walker | 52/302.3 |
| 6,694,686 | B2 | 2/2004 | Ready et al. | |
| 6,796,092 | B1 * | 9/2004 | Goebel | 52/302.1 |
| 6,886,302 | B2 | 5/2005 | Jackson | |
| 6,973,757 | B2 | 12/2005 | Marks | |
| 7,028,437 | B2 | 4/2006 | Hauck | |
| 7,051,485 | B2 | 5/2006 | Burnette | |
| 7,424,790 | B2 * | 9/2008 | Austin et al. | 52/94 |
| 8,082,712 | B1 * | 12/2011 | Butler et al. | 52/302.1 |
| 8,250,821 | B1 * | 8/2012 | Gibson | 52/302.3 |
| 8,316,601 | B2 * | 11/2012 | Cobb | 52/302.3 |
| 2004/0231260 | A1 | 11/2004 | Burkart | |
| 2005/0252151 | A1 * | 11/2005 | Kindred | 52/650.3 |
| 2006/0117688 | A1 | 6/2006 | Hauck | |
| 2006/0156640 | A1 | 7/2006 | Thomas | |
| 2006/0162262 | A1 | 7/2006 | Smith | |
| 2006/0288651 | A1 | 12/2006 | Zeng et al. | |
| 2009/0188190 | A1 | 7/2009 | Whitten | |
| 2009/0266018 | A1 * | 10/2009 | Stockton | 52/302.3 |
| 2012/0060428 | A1 * | 3/2012 | Lowrie III | 52/12 |

* cited by examiner

*Primary Examiner* — Joshua J Michener
*Assistant Examiner* — Elizabeth A Plummer
(74) *Attorney, Agent, or Firm* — Leffert Jay & Polglaze, P.A.

(57) ABSTRACT

In an embodiment, a deck drainage system has a water-receiving structure locatable under the deck and a gutter connectable to the deck adjacent to an end of the water-receiving structure for receiving water from the water-receiving structure. The water receiving structure comprises a plurality of interconnected troughs. Each trough of the plurality of interconnected troughs includes first and second opposing sidewalls. The first sidewall of a respective trough comprises a tab and a second sidewall of the respective trough comprises a channel. The tab of the first sidewall of a first trough of the plurality of interconnected troughs extends into the channel of the second sidewall of a successively adjacent second trough of the plurality of interconnected troughs.

22 Claims, 7 Drawing Sheets

DECK DRAINAGE SYSTEM

FIELD

The present disclosure relates generally to decks, and, in particular, in one or more embodiments, the present disclosure relates to deck drainage systems.

BACKGROUND

Outdoor decks e.g., adjacent to residential buildings, such as houses, provide outdoor living space, storage space, etc. The space underneath some decks, e.g., that might be accessible from a walkout basement, may also provide outdoor living space and/or storage space. However, openings in some decks, such as openings between the deck boards, allow water, such as rainwater, snow melt, water from washing the deck, etc., to enter the space underneath these decks. In addition, the water entering the space underneath through the openings may be mixed with dirt from the deck surface.

SUMMARY

According to an embodiment, a deck drainage system has a water-receiving structure locatable under the deck and a gutter connectable to the deck adjacent to an end of the water-receiving structure for receiving water from the water-receiving structure. The water receiving structure comprises a plurality of interconnected troughs. Each trough of the plurality of interconnected troughs includes first and second opposing sidewalls. The first sidewall of a respective trough comprises a tab and the second sidewall of the respective trough comprises a channel. The tab of the first sidewall of a first trough of the plurality of interconnected troughs extends into the channel of the second sidewall of a successively adjacent second trough of the plurality of interconnected troughs.

DETAILED DESCRIPTION

Figure 1:
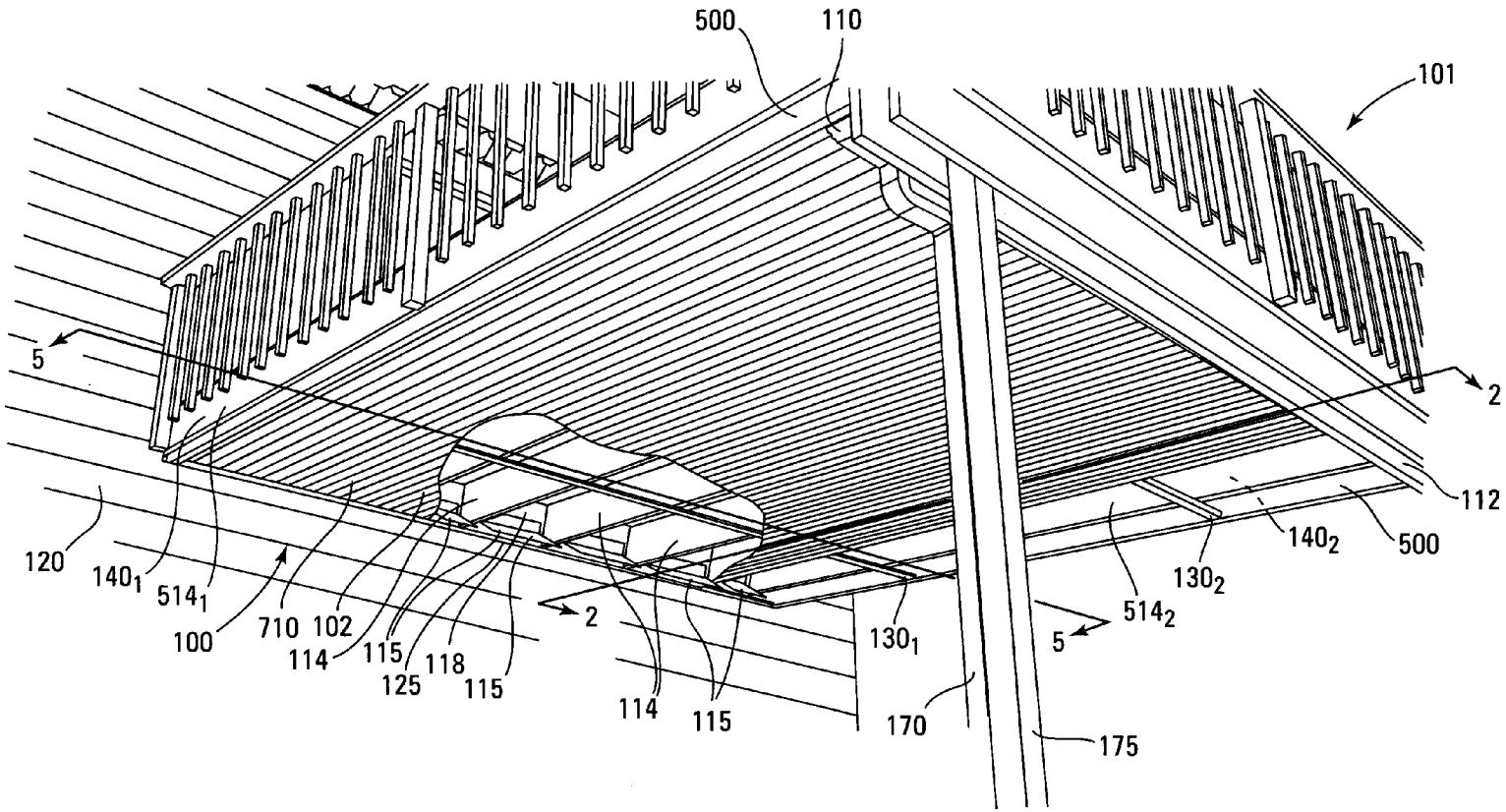
FIG. 1 is a perspective view of a deck drainage system, according to an embodiment.

In the following detailed description, reference is made to the accompanying drawings that form a part hereof, and in which is shown, by way of illustration, specific embodiments. In the drawings, like numerals describe substantially similar components throughout the several views. Other embodiments may be utilized and structural changes may be made without departing from the scope of the present disclosure. The following detailed description is, therefore, not to be taken in a limiting sense.

Figure 2:
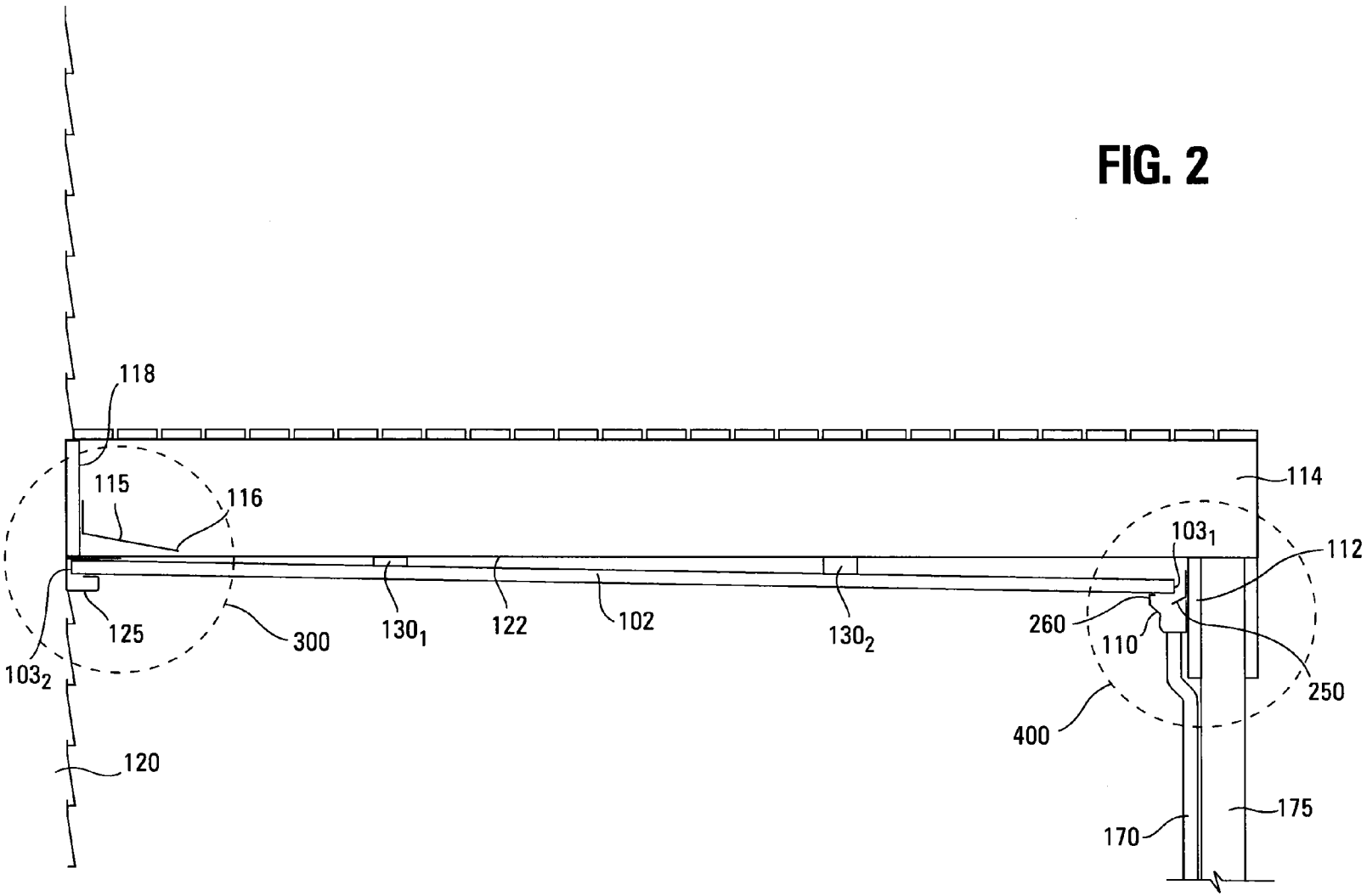
FIG. 2 is a view taken along line 2-2 of FIG. 1, according to another embodiment.
Figure 3:
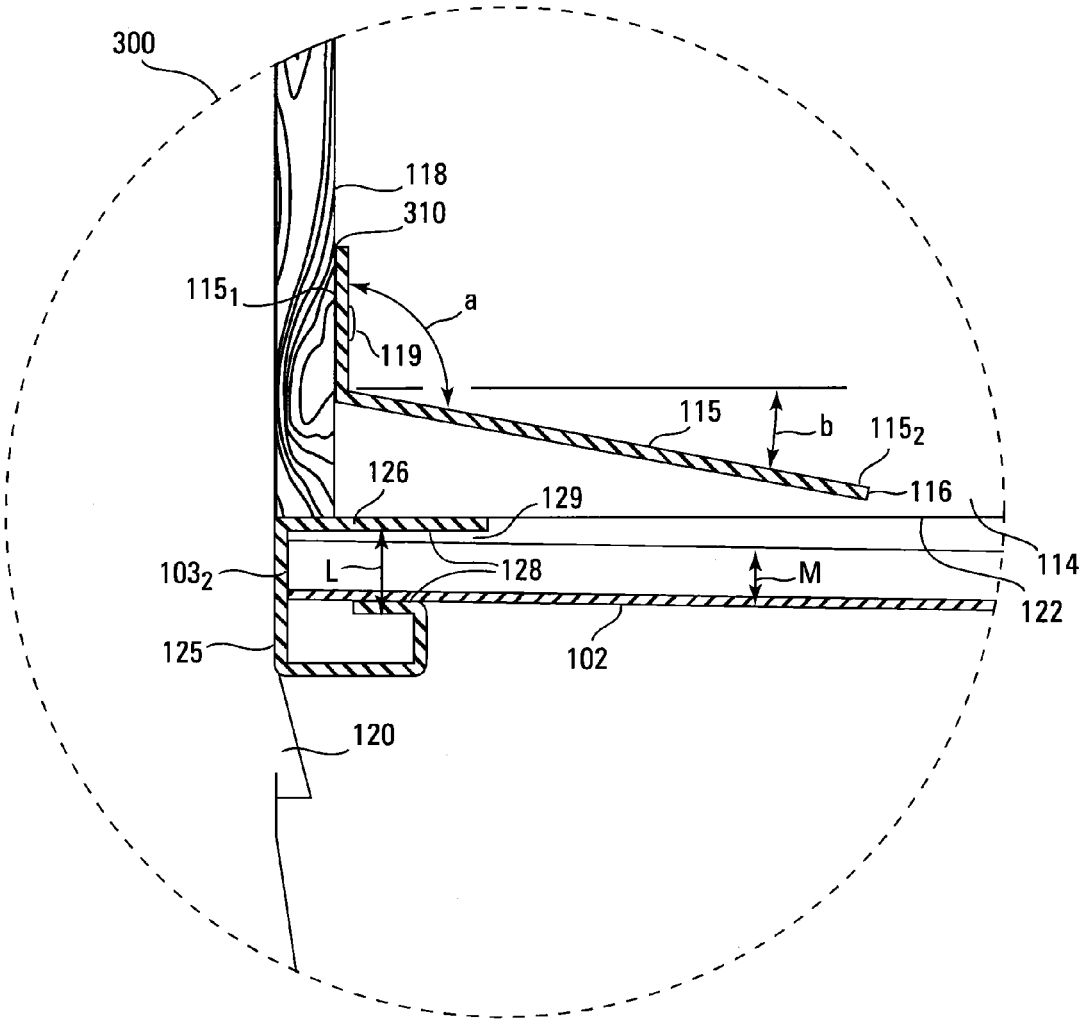
FIG. 3 is an enlarged view of region 300 in FIG. 2, according to another embodiment.
Figure 4:
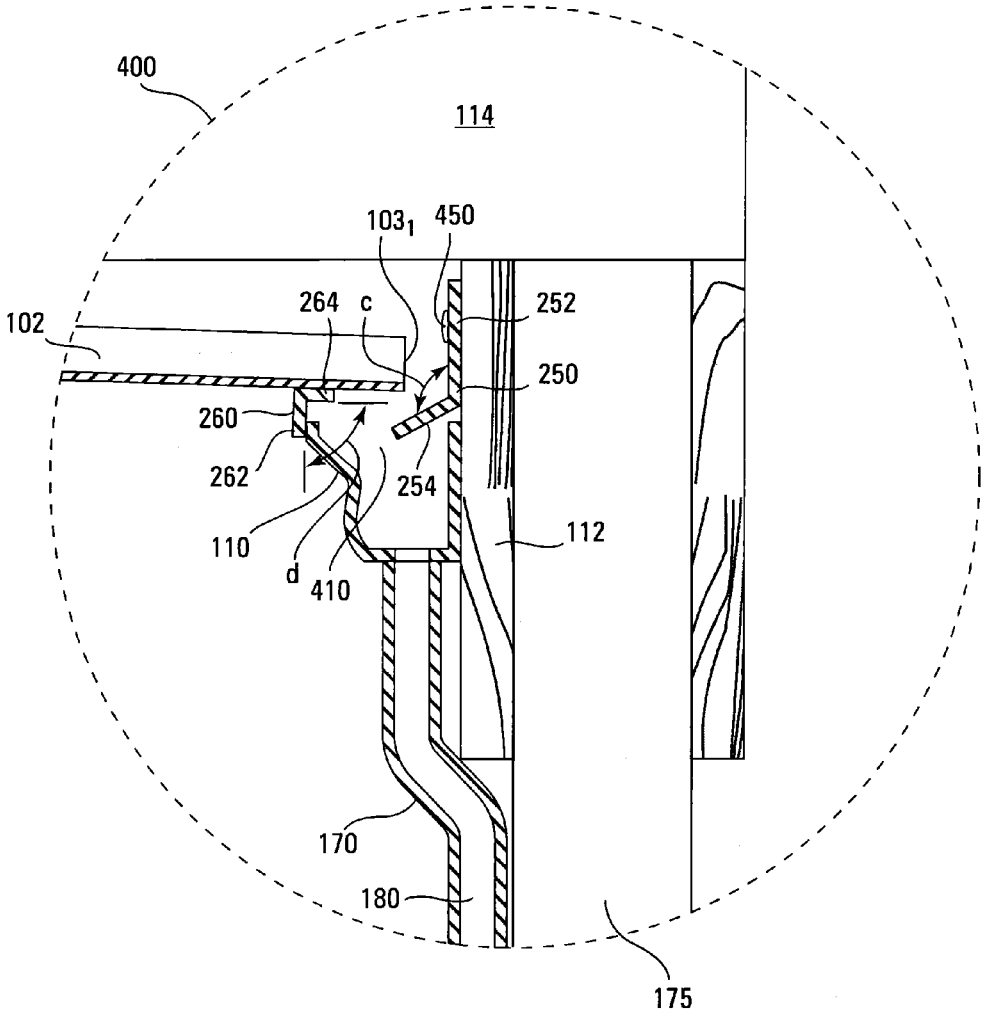
FIG. 4 is an enlarged view of region 400 in FIG. 2, according to another embodiment.
Figure 5:
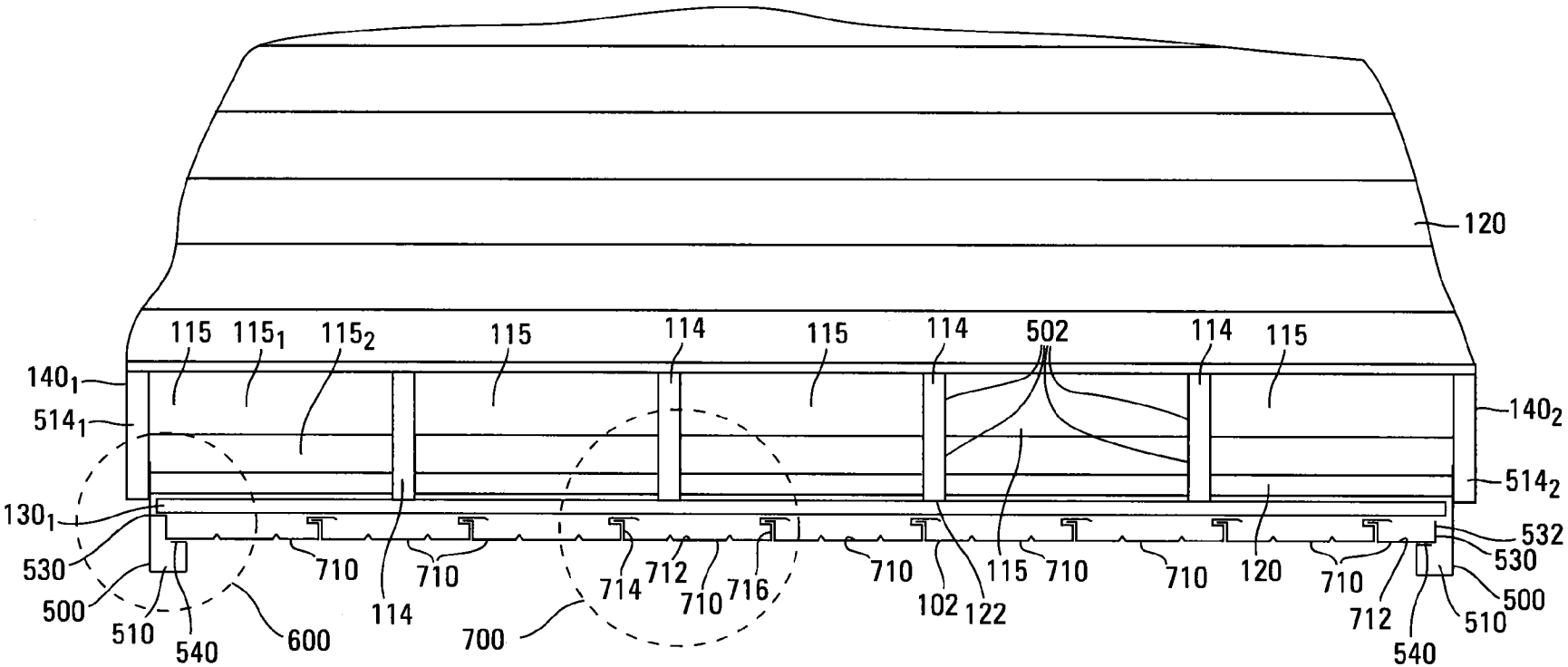
FIG. 5 is a view taken along line 5-5 of FIG. 1, according to another embodiment.
Figure 6:
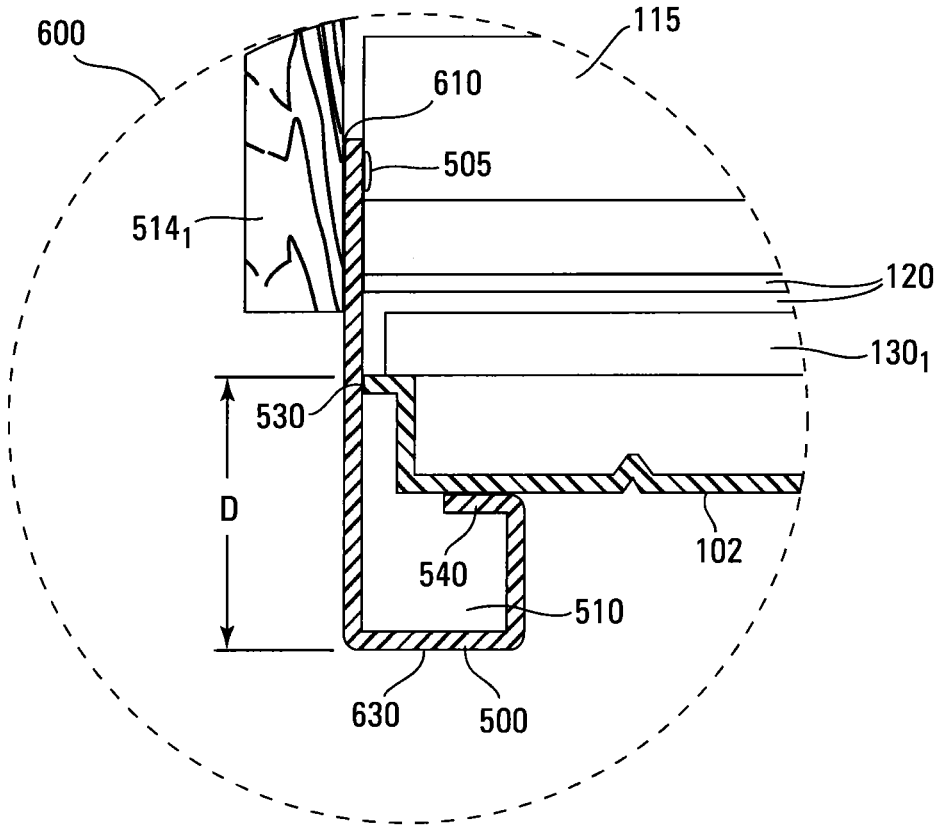
FIG. 6 is an enlarged view of region 600 in FIG. 5, according to another embodiment.
Figure 7:
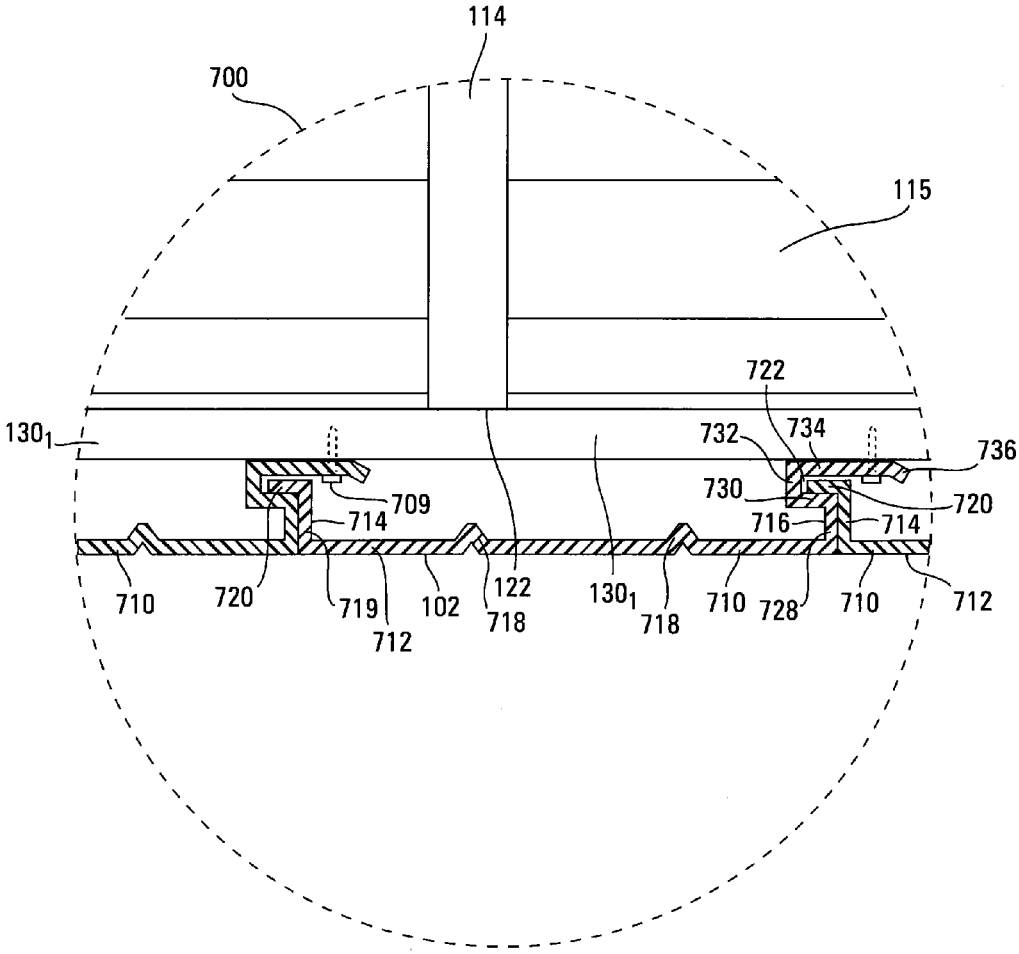
FIG. 7 is an enlarged view of region 700 in FIG. 5, according to another embodiment.

FIG. 1 illustrates a deck drainage system 100 (e.g., that may be called a deck apron) for underneath a deck 101. FIG. 2 is a view of deck drainage system 100 taken along line 2-2 of FIG. 1, and FIGS. 3 and 4 are respectively enlarged views of regions 300 and 400 in FIG. 2. FIG. 5 is a view of deck drainage system 100 taken along line 5-5 of FIG. 1, and FIGS. 6 and 7 are respectively enlarged views of regions 600 and 700 in FIG. 5.

Deck drainage system 100 may include a water-receiving structure 102 that is locatable under a deck, such as a deck 101. Deck drainage system 100 may include a gutter 110 that has an open channel 410 positioned adjacent to a distal end $\mathbf{103}_1$ of the water-receiving structure 102, as shown in FIG. 4. The distal end $\mathbf{103}_1$ of the water-receiving structure 102 may be aligned with the open channel 410 so that the open channel 410 can receive water from water-receiving structure 102. Gutter 110 may be connectable to the deck 101 adjacent to the distal end $\mathbf{103}_1$ of water-receiving structure 102. For example, gutter 110 may be connected (e.g., attached) to a support beam 112 of deck 101 that may be substantially perpendicular to joists 114 (FIGS. 2 and 4) of deck 101 and that may be substantially horizontal.

Deck drainage system 100 may include a plurality of water deflectors 115 (e.g., made from aluminum sheets, e.g., about 0.032 of an inch thick), where respective ones of the plurality of water deflectors 115 are locatable between successively adjacent joists 114 of the deck, as shown in FIGS. 1 and 5. Each of the plurality of water deflectors 115 may be connectable (e.g., attachable) to a surface 118 to which ends of joists 114 are connected, e.g., by screws, such as a screw 119 (FIG. 3).

Surface 118 may be adjacent to a proximal end $\mathbf{103}_2$ of the water-receiving structure, opposite distal end $\mathbf{103}_1$, as shown in FIG. 2. For example, surface 118 may be the surface of a ledger that may be affixed to a structure 120, such as a residential building, e.g., a house. For some embodiments, water deflectors 115 may be attached directly to structure 120.

For other embodiments, a distal end 116 of each of water deflectors 115 may be located vertically above and may be separated from an interior surface of water-receiving structure 102, as shown in FIG. 3. For example, the distal end 116 of each of water deflectors 115 may be located substantially flush with or vertically above (FIG. 3) a bottom edge 122 of joists 114.

Each deflector 115 may include portions $\mathbf{115}_1$ and $\mathbf{115}_2$ that from an angle a of greater than 90 degrees, e.g., about 125 degrees, with each other. This means that when portion $\mathbf{115}_1$ is attached to surface 118 and is substantially vertical, portion $\mathbf{115}_2$ is not horizontal, but angles below horizontal by an angle b, e.g., of about 35 degrees. For example, portion $\mathbf{115}_2$ angles downward from the surface 118 toward water receiving structure 102 so that distal end 116 is located vertically above a location on water-receiving structure 102 that is between the distal end $\mathbf{103}_1$ and the proximal end $\mathbf{103}_2$ of water-receiving structure 102, as shown in FIG. 2.

A sealant, such as silicone, may be applied to a seam 310 located between the upper end of portion $\mathbf{115}_1$ of each deflector 115 (FIG. 3) and the surface 118. Deflectors 115 direct any water running down a surface of the structure 120 to which deck 101 is attached into water receiving structure 102 and thus act to substantially prevent (e.g., prevent) this water from flowing behind deck drainage system 100 and into the region beneath deck drainage system 100.

As best seen from FIG. 5, each deflector 115 may span the entire distance between the successively adjacent joists 114 between which the respective deflector 115 is located. A sealant, such as silicone, may be applied to seams 502 between the respective sides of each deflector 115 and the joists 114 respectively adjacent to respective sides of the respective deflector 115.

Deck drainage system 100 may include a connector 125 (e.g., that may be called a starter channel), connectable to the joists 114 of deck 101, e.g., adjacent to structure 120, as shown in FIGS. 1, 2, and 3. For example, connector 125 may be butted against the structure 120 and secured to the bottom edges 122 of joists 114 by passing a screw through a portion 126 (e.g., that may be substantially horizontal) of the connector 125 (FIG. 3).

Connector 125 may have a channel 128 for receiving the proximal end $\mathbf{103}_2$ of water-receiving structure 102, as shown in FIG. 3. As such, connector 125 connects water-receiving structure 102 to the bottom of deck 101. A height L of channel 128 may be greater than a height M of water-receiving structure 102 to provide a clearance gap 129 between the top of water-receiving structure 102 and the top of channel 128 so that water-receiving structure 102 fits loosely within channel 128, allowing water-receiving structure 102 to angle downward from connector 125 toward gutter 110. Connector 125 may be formed from aluminum sheet (e.g., about 0.032 of an inch thick).

Deck drainage system 100 may further include one or more spacers 130 (e.g., of wood), such as spacers $\mathbf{130}_1$ and $\mathbf{130}_2$ (FIGS. 1 and 2), connectable (e.g., attachable) to the bottom edges 122 of joists 114, e.g., by screws, and to portions of water-receiving structure 102, e.g., by screws 709 (FIG. 7), so that a spacer 130 is interposed between the bottom edges 122 of joists 114 and the portions of the water-receiving structure 102.

A spacer 130 causes water-receiving structure 102 to angle downward from the proximal end $\mathbf{103}_2$ of the water-receiving structure 102 toward the gutter 110, as shown in FIG. 2, so that the distal end $\mathbf{130}_1$ is at a lower elevation than the proximal end $\mathbf{103}_2$. For example, spacer $\mathbf{130}_1$ (e.g., a standard "one-by-four" board) spaces the portion of water-receiving structure 102 attached thereto to be at a greater distance from the bottom edges 122 of joists 114, and thus at a lower elevation, than proximal end $\mathbf{103}_2$. Spacer $\mathbf{130}_2$ (e.g., a standard "two-by-four" board) is progressively thicker than spacer $\mathbf{130}_1$ and progressively spaces the portion of water-receiving structure 102 attached thereto to be at a greater distance from the bottom edges 122 of joists 114, and thus at a lower elevation, than the portion of water-receiving structure attached to spacer $\mathbf{130}_1$. A distance between spacers $\mathbf{130}_1$ and $\mathbf{130}_2$ may be about four feet for an embodiment.

For some embodiments, water receiving structure 102 may be an assembly of a plurality of troughs 710 (e.g., that may be referred to as channular-shaped "panels"), as shown in FIG. 7. Each trough 710 may include a bottom 712 interposed between and connected to opposing sidewalls 714 and 716, e.g., that may be integral with bottom 712. For other embodiments, one or more ribs 718, e.g., substantially parallel (e.g., parallel) to sidewalls 714 and 716, may be integrally formed in bottom 712 and may be interposed between sidewalls 714 and 716.

Sidewall 714 may include a portion 719 that may extend substantially vertically (e.g., vertically) from bottom 712 and may be substantially perpendicular (e.g., perpendicular) to bottom 712. Sidewall 714 may include a tab 720 that may extend from portion 719 in a direction away from sidewall 716 and that may be substantially perpendicular (e.g., perpendicular) to portion 719.

Sidewall 716 may include a channel 722 for receiving a tab 720 of a sidewall 714 of a successively adjacent trough 710. As such, channel 722 configures sidewall 716 as a female sidewall and tab 720 configures sidewall 714 as a male sidewall, since tab 720 fits into channel 722. Therefore, each trough 710 has an asymmetric cross-section having a male sidewall 714 and a female sidewall 716. Note that only sidewall 716 has a channel 722 for some embodiments. Channel 722 extends in a direction toward sidewall 714 and over bottom 712 of its respective trough 712. Receiving a tab 720 in a channel 722 interconnects (e.g., interlocks) successively adjacent troughs 710 together to form water receiving structure 102.

Sidewall 716 may include a portion 728 that may extend substantially vertically (e.g., vertically) upward from bottom 712 and may be substantially perpendicular (e.g., perpendicular) to bottom 712. Sidewall 716 may include a portion 730 that may extend from portion 728 in a direction toward sidewall 714 over bottom 712 and that may be substantially perpendicular (e.g., perpendicular) to portion 728. Sidewall 716 may include a portion 732 that may extend substantially vertically upward (e.g., vertically upward) from portion 730 and that may be substantially perpendicular (e.g., perpendicular) to portion 730. Sidewall 716 may include a portion 734 that may be substantially perpendicular (e.g., perpendicular) to portion 732 and that may extend substantially parallel (e.g., parallel) to portion 730 and to bottom 712 in a direction away from sidewall 714 and past portion 728.

Note that portion 732 interconnects portions 730 and 734. Also note that the screws 709 that attach water receiving structure to a spacer 130 pass through the portions 734 of the sidewalls 716 of the respective troughs 710, where the screws 709 passing through the portion 734 of the sidewall 716 of a given trough 710 are directly vertically aligned with a bottom 712 of a successively adjacent trough 710, as shown in FIG. 7.

Portions 730, 732, and 734 form boundaries of a channel 722 and thus define the channel 722 therein. A tab 736 of sidewall 716 may angle downwardly from portion 734 into the successively adjacent trough 710. For example, the tab 736 of sidewall 716 may angle downwardly from portion 734, e.g., tab 736 may angle downwardly from the horizontal, in front of a portion of an opening to channel 722.

When tab 720 of a sidewall 714 of a successively adjacent trough 710 is located within a channel 722, portion 734 extends past the sidewall 714 of the successively adjacent trough 710 and over a portion of the bottom 712 of the successively adjacent trough 710, and tab 736 angles downwardly from the horizontal toward the bottom 712 of the successively adjacent trough 710.

For portions of the successively adjacent troughs 710 that are not aligned with a spacer 130, e.g., that are between spacers $\mathbf{130}_1$ and $\mathbf{130}_2$, the portion 734 that extends past the sidewall 714 of one of the successively adjacent troughs 710 and the angling tab 736 act to direct water into that successively adjacent trough 710, thereby substantially preventing (e.g., preventing) the water from flowing between the successively adjacent troughs 710 and into region below deck drainage system 100. Note that each of the troughs 710 may be formed from aluminum sheets, e.g., about 0.032 of an inch thick.

Deck drainage system 100 may include opposing end caps 500, as shown in FIGS. 1, 5, and 6. End caps 500 may be mirror images of each other, as shown in FIG. 5.

One of end caps 500 is connectable (e.g., attachable) to a joist $\mathbf{514}_1$ of deck 101 that forms a side $\mathbf{140}_1$ of deck 101, and the other of end caps 500 is connectable (e.g., attachable) to a joist $\mathbf{514}_2$ of deck 101 that forms an opposite side $\mathbf{140}_2$ of deck 101. End caps 500 may each be attached to an interior surface of a respective joist 514 using screws, such as a screw 505, as shown in FIG. 6.

End caps 500 may each include an open channel 510, as shown in FIGS. 5 and 6. The end caps 500 each extend under a bottom of water-receiving structure 102 so that opposing sides 530 of water-receiving structure 102 respectively align with the open channels 510 of end caps 500, as shown in FIG. 5. For example, a portion 540, e.g., that may be substantially horizontal (e.g., horizontal), of each end cap 500 that is adjacent to an opening to the channel 510 of the respective end cap 500 may form a ledge that engages the bottom of water-receiving structure 102 for supporting water-receiving structure 102, as shown in FIGS. 5 and 6.

Note that the last trough 710 adjacent to an end cap 500 (e.g., the end cap 500 at the right in FIG. 5) may not be a complete trough 710. Instead, the last trough 710 may be cut to fit between the previous trough 710 and the respective end cap 500. A sidewall 532, e.g., corresponding to a side 530 of water-receiving structure 102, may be formed by bending a portion of the bottom 712 of the last trough 710 substantially vertically upward (e.g., vertically upward), e.g., so as to be substantially perpendicular (e.g., perpendicular) to the remainder of the bottom 712 of the last trough 710.

End caps 500 may each angle downwardly (e.g., from the horizontal) in a direction from the structure 120 (e.g., from adjacent to the surface 118 to which deflectors 115 attach) toward gutter 110. That is, the end caps 500 may each angle downwardly relative to a respective side 140 of deck 101. Note that connector 125 may extend from one of the end caps 500 to the other of end caps 500, as shown in FIG. 1. Gutter 110 may also extend from one of the end caps 500 to the other of end caps 500.

For some embodiments, the end caps 500 may incline downwardly at about the same rate as water-receiving structure 102. That is, the end caps 500 and water-receiving structure 102 may angle downward from horizontal by about the same angle.

For example, each end cap 500 may be positioned so that its bottom surface 630 is a distance D below a respective spacer 130, e.g., as shown in FIG. 6 for spacer $\mathbf{130}_1$. Since spacer $\mathbf{130}_2$ is thicker than spacer $\mathbf{130}_1$, positioning an end cap 500 so that its bottom surface 630 is distance D below spacers $\mathbf{130}_1$ and $\mathbf{130}_2$ causes that end cap 500 to be inclined and to angle downward from spacer $\mathbf{130}_1$ toward spacer $\mathbf{130}_2$.

A sealant, such as silicone, may be applied to a seam 610 (FIG. 6) located between the upper end of each end cap 500 and the interior surface of the respective joist 514 to which the respective end cap 500 is attached. Each end cap 500 may be formed from aluminum sheet (e.g., about 0.032 of an inch thick).

An end of the channel 510 of each end cap 500 may align with the opening to the open channel 410 in gutter 110. The channel 510 of each end cap 500 may receive water from the opposing sides 530 of water-receiving structure 102 and direct the water to gutter 110.

Deck drainage system 100 may include a deflector 250 (e.g., that may be called a drip edge) connectable (e.g., attachable) to the deck adjacent to gutter 110, as shown in FIGS. 2 and 4. For example, deflector 250 may be attached to support beam 112 by screws, such as screw 450, that pass through a portion 252 (FIG. 4) of deflector 250. Deflector 250 may extend from one of the end caps 500 to the other of end caps 500.

When deflector 250 is attached to support beam 112, portion 252 may be substantially vertical (e.g., vertical). Deflector 250 may have a portion 254 that may extend into open channel 410 of gutter 110, as shown in FIG. 4. That is, portion 254 may angle downward from portion 252 (e.g., from horizontal) and thus support beam 112 into open channel 410.

For some embodiments, portions 252 and 254 of deflector 250 may form an angle c with each other that may be greater than 90, e.g., about 135 degrees, so that portion 254 may angle downward from horizontal when portion 252 is attached to support beam 112. For example, portion 254 may angle downward from horizontal by about 45 degrees when portion 252 is attached to support beam 112.

Deflector 250 acts to substantially prevent (e.g. prevent) water that is flowing from water-receiving structure 102 into gutter 110 from flowing past the opening to open channel 410 in gutter 110. For example, portion 254 directs the water into open channel 410. Deflector 250 may be formed from aluminum sheet (e.g., about 0.032 of an inch thick).

Deck drainage system 100 may include a cover 260 (e.g., that may be called a pest blocker) that may be connected (e.g., attached) to gutter 110, as shown in FIGS. 2 and 4. For example, cover 260 may be attached to gutter 110 adjacent to the opening to the open channel 410.

Cover 260 may extend from where it is attached to gutter 110 to a bottom of water-receiving structure 102 so as to contact the bottom of the water-receiving structure 102. Cover 260 covers an opening between gutter 110 and the bottom of the water-receiving structure 102 for substantially preventing (e.g., preventing) animals (e.g., mice, birds, etc.) access to gutter 110 and/or access to the interior of deck drainage system 100.

Cover 260 may be formed from aluminum sheet (e.g., about 0.032 of an inch thick). Cover 260 may extend from one of the end caps 500 to the other of end caps 500.

Cover 260 may include portions 262 and 264 that form an angle d with each other that may be about 75 degrees. Portion 262 is attached to gutter 110 adjacent to the opening to the open channel 410 and may be substantially vertical (e.g., vertical) when attached to gutter 110.

For some embodiments, angle d is such that when portion 262 is substantially vertical (e.g., vertical), portion 264 is substantially parallel (e.g., parallel) with the bottom of the water-receiving structure 102. That is, portion 262 and water-receiving structure 102 may incline downward by substantially the same (e.g., the same) angle from horizontal. For example, when angle d is about 75 degrees and portion 262 is substantially vertical (e.g., vertical), portion 264 may angle downward from horizontal by about 15 degrees.

A conduit 170, such as a downspout, may be connected (e.g., attached) to a support post 175 of deck 101 and to gutter 110, as shown in FIGS. 1, 2, and 4, so that a flow passage 180 within conduit 170 is fluidly coupled to the open channel 410 of gutter 110.

In some embodiments, an example method of forming a drainage system, such as drainage system 100, under a deck, such as deck 101, includes forming a water-receiving structure, such as water-receiving structure 102, under the deck and connecting a gutter, such as gutter 110, to the deck, such as to support beam 112, adjacent to an end, such as distal end $\mathbf{103}_1$, of the water-receiving structure. Forming the water-receiving structure under the deck may include interconnecting a plurality troughs, such as troughs 710, of the water-receiving structure by receiving a tab, such as tab 720, of a first sidewall, such as sidewall 714, of a first trough of the plurality troughs in a channel, such as channel 722, of a second sidewall, such as sidewall 716, of a successively adjacent second trough of the plurality of troughs.

The end of the of the water-receiving structure may be a first end of the water-receiving structure, and the method may further include connecting a plurality of water deflectors, such as water deflectors 115, to a surface, such as surface 118, to which ends of joists of the deck, such as joists 114 and joists 514, are connected and that is adjacent to a second end, such as proximal end $103_2$, of the water-receiving structure opposite the first end so that respective ones of the plurality of water deflectors are respectively located between successively adjacent joists of the deck, where each water deflector of the plurality of water deflectors angles downwardly away from the surface toward the water-receiving structure. For some embodiments, the water deflectors may be connected to the surface before forming the water-receiving structure and before connecting the gutter.

The method may further include connecting a connector, such as connector 125, to bottom edges of the joists and receiving the second end of the water-receiving structure into a channel, such as channel 128, of the connector, where a clearance gap, such as clearance gap 129, is located between a top of the channel and a top of the water-receiving structure. For some embodiments, connecting the connector to the bottom edges of the joists may occur after connecting the water deflectors and before forming the water-receiving structure and before connecting the gutter.

The method may further include interposing a spacer, such as spacer $130_1$ and/or spacer $130_2$, between the bottom edges of joists and a portion of the second sidewall of the successively adjacent second trough that forms a portion of a boundary of the channel of the second sidewall, and attaching the portion of the second sidewall of the successively adjacent second trough to the spacer, e.g., using a screw 709, where the spacer causes the water-receiving structure to incline downward toward the gutter. For some embodiments, the spacers may be connected to the joists after connecting the connector to the joists and before forming the water-receiving structure and before connecting the gutter.

The method may further include respectively connecting first and second caps, such as end caps 500, to the joists, such as joists $514_1$ and $514_2$, that respectively form opposing sides, such as opposing sides $140_1$ and $140_2$, of the deck, where the first and second caps each extend under a bottom of the water-receiving structure so that opposing sides, such as sides 530, of the water-receiving structure respectively align with open channels, such as open channels 510, of the first and second caps, where the first and second caps incline downward toward the gutter. For some embodiments, the first cap, such as the end cap 500 at the left of FIG. 5, may be connected to a respective joist after connecting the spacers to the joists and before forming the water-receiving structure and before connecting the gutter. For other embodiments, the water-receiving structure may be formed after connecting the first cap to its respective joist and before connecting the gutter. The second cap, e.g., the end cap 500 at the right in FIG. 5, may then be connected to its respective joist after forming the water-receiving structure and before connecting the gutter.

The method may further include connecting another deflector, such as deflector 250, to the deck, such as to support beam 112, adjacent to the gutter, where the other deflector has a portion, such as portion 254, that extends into the gutter. For some embodiments, the other deflector may be connected to the deck after connecting the second cap to its respective joist and before connecting the gutter. For other embodiments, the gutter may then be connected to the deck after connecting the second deflector to the deck.

For one embodiment, the method may include, connecting a conduit, such as conduit 170, to the gutter and to the deck, such as to support post 175, after the gutter is connected to the deck.

The method may further include connecting a cover, such as cover 260, to the gutter so that the cover extends from the gutter into contact with a bottom of the water-receiving structure so that the cover covers an opening between the gutter and the bottom of the water-receiving structure. For some embodiments, the cover may be connected to the gutter after connecting the conduit to the gutter.

CONCLUSION

Although specific embodiments have been illustrated and described herein, it is manifestly intended that these embodiments not be taken in a limiting sense.

What is claimed is:

1. A deck drainage system, comprising:

a water-receiving structure locatable under a deck; and a gutter connectable to the deck adjacent to an end of the water-receiving structure for receiving water from the water-receiving structure;

wherein the water-receiving structure comprises a plurality of interconnected troughs, wherein each trough of the plurality of interconnected troughs comprises first and second opposing sidewalls;

wherein the first sidewall of at least a first trough of the plurality of interconnected troughs and at least a successively adjacent second trough of the plurality of interconnected troughs comprises a vertical portion and a horizontal tab perpendicular to the vertical portion;

wherein the second sidewall of at least the first trough and at least the successively adjacent second trough comprises a vertical portion and a channel having a horizontal upper boundary formed by a horizontal portion of the second sidewall;

wherein the horizontal tab of the first sidewall of the first trough extends into the channel of the second sidewall of the successively adjacent second trough and wherein the vertical portion of the first sidewall of the first trough abuts the vertical portion of the second sidewall of the successively adjacent second trough; and wherein the horizontal upper boundary of the channel of the second sidewall of the successively adjacent second trough extends from a location that is directly vertically above a location on a bottom of the successively adjacent second trough between the vertical portion of the first sidewall of the successively adjacent second trough and the vertical portion of the second sidewall of the successively adjacent second trough past the vertical portion of the first sidewall of the first trough to a location that is directly vertically above a location on a bottom of the first trough between the vertical portion of the first sidewall of the first trough and the vertical portion of the second sidewall of the first trough.

2. The deck drainage system of claim 1, wherein each trough of the plurality of interconnected troughs comprises one or more ribs formed in a bottom of the respective trough.

3. The deck drainage system of claim 1, wherein the horizontal portion of the second sidewall of the successively adjacent second trough that forms the horizontal upper boundary of the channel of the second sidewall of the successively adjacent second trough is a first horizontal portion of the second sidewall of the successively adjacent second trough and the vertical portion of the second sidewall of the successively adjacent second trough is a first vertical portion of the second sidewall of the successively adjacent second trough, wherein the second sidewall of the successively adjacent second trough further comprises a second horizontal portion that forms a horizontal lower boundary of the channel of the second sidewall of the successively adjacent second trough and that is connected to the first horizontal portion of the second sidewall of the successively adjacent second trough by a second vertical portion of the second sidewall of the successively adjacent second trough, and wherein the second horizontal portion of the second sidewall of the successively adjacent second trough is also connected to the first vertical portion of the second sidewall of the successively adjacent second trough so that the second horizontal portion of the second sidewall of the successively adjacent second trough is between the first and second vertical portions of the second sidewall of the successively adjacent second trough.

4. The deck drainage system of claim 1, wherein an angled portion of the second sidewall of the successively adjacent second trough is connected to the horizontal portion of the second sidewall of the successively adjacent second trough that forms the horizontal upper boundary of the channel of the second sidewall of the successively adjacent second trough and angles downwardly from the horizontal portion of the second sidewall of the successively adjacent second trough, starting at the location that is directly vertically above the location on the bottom of the first trough between the vertical portion of the first sidewall of the first trough and the vertical portion of the second sidewall of the first trough, into the first trough in front of a portion of an opening to the channel of the second sidewall of the successively adjacent second trough.

5. The deck drainage system of claim 1, wherein the horizontal portion of the second sidewall of the successively adjacent second trough that forms the horizontal upper boundary of the channel of the second sidewall of the successively adjacent second trough is attached to a spacer interposed between bottom edges of joists of the deck and the horizontal portion of the second sidewall of the successively adjacent second trough that forms the horizontal upper boundary of the channel of the second sidewall of the successively adjacent second trough.

6. The deck drainage system of claim 1, wherein only the second sidewall of at least the first trough and at least the successively adjacent second trough comprises the channel.

7. The deck drainage system of claim 1, further comprising a downspout connected to the gutter.

8. A deck drainage system, comprising:

a water-receiving structure locatable under a deck and comprising a proximal end locatable adjacent to a structure to which the deck is attached and a distal end locatable distally from the structure to which the deck is attached;

a connector locatable adjacent to the structure to which the deck is attached and having a channel that receives the proximal end of the water-receiving structure;

a gutter connectable to the deck adjacent to the distal end of the water-receiving structure for receiving water from the water-receiving structure, wherein the water-receiving structure angles downward from the connector toward the gutter so that the proximal end is at a higher elevation than distal end;

caps respectively adjacent to first and second sides of the water-receiving structure, each cap comprising a ledge that engages a bottom of the water-receiving structure, each cap angling downward from adjacent to the connector toward the gutter so that each of the caps is at a higher elevation adjacent to the connector than adjacent to the gutter, each cap comprising an open channel with an opening over which the bottom of the water-receiving structure extends, the ledge of each cap terminating at the opening to the channel of that cap and forming an upper boundary of the channel of that cap;

a plurality of water deflectors, respective ones of the plurality of water deflectors locatable between successively adjacent joists of the deck, each of the plurality of water deflectors connectable to a surface to which ends of the joists of the deck are connected and that is adjacent to the proximal end of the water-receiving structure;

wherein each of the water deflectors angles downwardly from the surface to which the ends of joists of the deck are connected so that a distal end of each of the water deflectors is located directly vertically above and is separated from a location in an interior of the water-receiving structure that is between the proximal and distal ends of the water-receiving structure and so that each deflector is at a higher elevation adjacent to the surface to which the ends of joists of the deck are connected than at the distal end of that deflector.

9. The deck drainage system of claim 8, wherein each of the water deflectors spans an entire distance between the successively adjacent joists, and wherein one joist is between successively adjacent water deflectors.

10. The deck drainage system of claim 8, wherein a clearance gap is located between a top of the channel of the connector and a top of the water-receiving structure.

11. The deck drainage system of claim 8, wherein the plurality of water deflectors is a plurality of first water deflectors, and further comprising a second deflector connectable to the deck adjacent to the gutter, the second deflector comprising a portion that extends into the gutter.

12. The deck drainage system of claim 8, further comprising a cover connected to the gutter and extending from the gutter into contact with the bottom of the water-receiving structure, the cover covering an opening between the gutter and the bottom of the water-receiving structure, wherein the cover extends from one of the caps to another of the caps, and wherein a portion of the cover that contacts the bottom of the water-receiving structure angles downward from horizontal toward the gutter by a same angle as the water-receiving structure.

13. The deck drainage system of claim 8, wherein one of the caps is connectable to a joist of the deck that forms a side of the deck and another of the caps is connectable to a joist of the deck that forms an opposite side of the deck.

14. The deck drainage system of claim 8, wherein an end of the open channel of each of the caps aligns with an open channel in the gutter.

15. The deck drainage system of claim 8, further comprising a spacer connectable to a bottom of the joists of the deck and to portions of the water-receiving structure so that the spacer is interposed between the bottom of the joists of the deck and the portions of the water-receiving structure, the spacer causing the water-receiving structure to angle downward from the connector toward the gutter.

16. The deck drainage system of claim 8, wherein the water-receiving structure comprises a plurality of interconnected troughs, each of the troughs comprising first and second opposing sidewalls;

wherein the first sidewall of at least a first trough of the plurality of interconnected troughs and at least a successively adjacent second trough of the plurality of interconnected troughs comprises a vertical portion and a horizontal tab perpendicular to the vertical portion;

wherein the second sidewall of at least the first trough and at least the successively adjacent second trough comprises a vertical portion and a channel having a horizontal upper boundary formed by a horizontal portion of the second sidewall;

wherein the horizontal tab of the first sidewall of the first trough extends into the channel of the second sidewall of the successively adjacent second trough and wherein the vertical portion of the first sidewall of the first trough abuts the vertical portion of the second sidewall of the successively adjacent second trough; and wherein the horizontal upper boundary of the channel of the second sidewall of the successively adjacent second trough extends from a location that is directly vertically above a location on a bottom of the successively adjacent second trough between the vertical portion of the first sidewall of the successively adjacent second trough and the vertical portion of the second sidewall of the successively adjacent second trough past the vertical portion of the first sidewall of the first trough to a location that is directly vertically above a location on a bottom of the first trough between the vertical portion of the first sidewall of the first trough and the vertical portion of the second sidewall of the first trough.

17. A method of forming a drainage system under a deck, comprising:

forming a water-receiving structure under the deck, the water-receiving structure comprising a proximal end adjacent to a structure to which the deck is attached and a distal end located distally from the structure to which the deck is attached, wherein the water-receiving structure angles downward from the proximal end of the water-receiving structure toward the distal end of the water-receiving structure;

connecting a plurality of water deflectors to a surface to which ends of joists of the deck are connected and that is adjacent to the proximal end of the water-receiving structure so that respective ones of the plurality of water deflectors are respectively located between successively adjacent joists of the deck, wherein each of the water deflectors angles downwardly from the surface to which ends of joists of the deck are connected so that a distal end of each of the water deflectors is located directly vertically above and is separated from a location in an interior of the water-receiving structure that is between the proximal and distal ends of the water-receiving structure and so that each deflector is at a higher elevation adjacent to the surface to which ends of joists of the deck are connected than at the distal end of that deflector; and connecting a gutter to the deck adjacent to the distal end of the water-receiving structure;

wherein forming the water-receiving structure under the deck comprises interconnecting a plurality troughs of the water-receiving structure by receiving a horizontal tab of a first sidewall of a first trough of the plurality troughs in a horizontal channel of a first sidewall of a successively adjacent second trough of the plurality of troughs;

wherein a horizontal upper boundary of the horizontal channel of the first sidewall of the successively adjacent second trough extends from a location that is directly vertically above a location on a bottom of the successively adjacent second trough between a vertical portion of the first sidewall of the successively adjacent second trough and a second sidewall of the successively adjacent second trough past the first sidewall of the first trough to a location that is directly vertically above a location on a bottom of the first trough between the first sidewall of the first trough and a second sidewall of the first trough.

18. The method of claim 17, further comprising connecting a connector to bottom edges of the joists of the deck adjacent to the structure to which the deck is attached, and receiving the proximal end of the water-receiving structure into a channel of the connector, wherein a clearance gap is located between a top of the channel and a top of the water-receiving structure.

19. The method of claim 17, wherein the water deflectors of the plurality of water deflectors are first water deflectors, and further comprising connecting a second water deflector to the deck adjacent to the gutter, the second water deflector comprising a portion that extends into the gutter.

20. The method of claim 17, further comprising connecting a cover to the gutter that extends from the gutter into contact with a bottom of the water-receiving structure so that the cover covers an opening between the gutter and the bottom of the water-receiving structure, wherein a portion of the cover that contacts the bottom of the water-receiving structure angles downward from horizontal by a same angle as the water-receiving structure.

21. The method of claim 17, further comprising respectively connecting first and second caps to joists of the deck that respectively form opposing sides of the deck, wherein opposing sides of the water-receiving structure respectively align with open channels of the first and second caps, wherein each of the first and second caps angles downward from adjacent to the proximal end of the water-receiving structure toward the distal end of the water-receiving structure so that each of the first and second caps is at a higher elevation adjacent to the proximal end of the water-receiving structure than adjacent to the distal end of the water-receiving structure.

22. The method of claim 17, further comprising interposing a spacer between bottom edges of the joists of the deck and a horizontal portion of the first sidewall of the successively adjacent second trough that forms the horizontal upper boundary of the horizontal channel of the first sidewall of the successively adjacent second trough, and attaching the horizontal portion of the first sidewall of the successively adjacent second trough to the spacer, wherein the spacer causes the water-receiving structure to angle downward from the proximal end of the water-receiving structure toward the distal end of the water-receiving structure.

* * * * *